US005623894A

United States Patent [19]

Clarke

[11] Patent Number: 5,623,894

[45] Date of Patent: Apr. 29, 1997

[54] DUAL COMPRESSION AND DUAL EXPANSION ENGINE

[75] Inventor: John M. Clarke, Chillicothe, Ill.

[73] Assignee: Caterpillar Inc., Peoria, Ill.

[21] Appl. No.: 557,874

[22] Filed: Nov. 14, 1995

[51] Int. Cl.[6] ..... F02B 59/00

[52] U.S. Cl. ..... 123/50 R

[58] Field of Search ..... 123/42, 50 R, 123/50 A, 50 B, 51 A, 51 B

[56] References Cited

U.S. PATENT DOCUMENTS

| | | | |
|---|---|---|---|
| 973,800 | 10/1910 | McKinnon . | |
| 1,213,316 | 1/1917 | Well . | |
| 1,374,140 | 4/1921 | Dock . | |
| 1,677,460 | 7/1928 | Pope, Jr. . | |
| 1,707,005 | 3/1929 | Hall . | |
| 2,086,705 | 7/1937 | Ellis . | |
| 2,158,442 | 5/1939 | Tipton . | |
| 2,984,966 | 5/1961 | Harris . | |
| 3,187,731 | 6/1965 | Caddell . | |
| 4,037,527 | 7/1977 | Steffen . | |
| 4,325,331 | 4/1982 | Erickson | 123/50 R |
| 4,487,172 | 12/1984 | Suhre . | |
| 4,969,918 | 11/1990 | Taniguchi . | |
| 5,054,438 | 10/1991 | Takashima | 123/50 R |
| 5,083,530 | 1/1992 | Rassey . | |
| 5,183,014 | 2/1993 | Stevenson . | |
| 5,327,858 | 7/1994 | Hausknecht . | |
| 5,351,657 | 10/1994 | Buck . | |
| 5,456,219 | 10/1995 | Clarke | 123/50 B |

OTHER PUBLICATIONS

US Application No. 08/119,106 filed Apr. 1, 1991 entitled "Dual Compression and Dual Expansion Internal Combution Engine and method Therefor".

*Primary Examiner*—Marguerite McMahon
*Attorney, Agent, or Firm*—David L. Polsley

[57] ABSTRACT

An improved dual compression and dual expansion internal combustion engine defined by an external housing with a first piston sleeve and a second piston sleeve, a reciprocating internal housing disposed within the external housing, the internal housing having a conical first piston member operatively disposed in the first piston sleeve to define a first compression chamber and a conical second piston member operably disposed in the second piston sleeve to define a second expansion chamber, and the internal housing further defining an operating chamber assembly with two reciprocating, opposed pistons disposed in a rotationally oscillating cylinder sleeve valve therein to form a combustion chamber, the cylinder sleeve valve providing selective flow connection from the first compression chamber to the combustion chamber and to the second expansion chamber from the combustion chamber.

112 Claims, 6 Drawing Sheets

Fig.3.
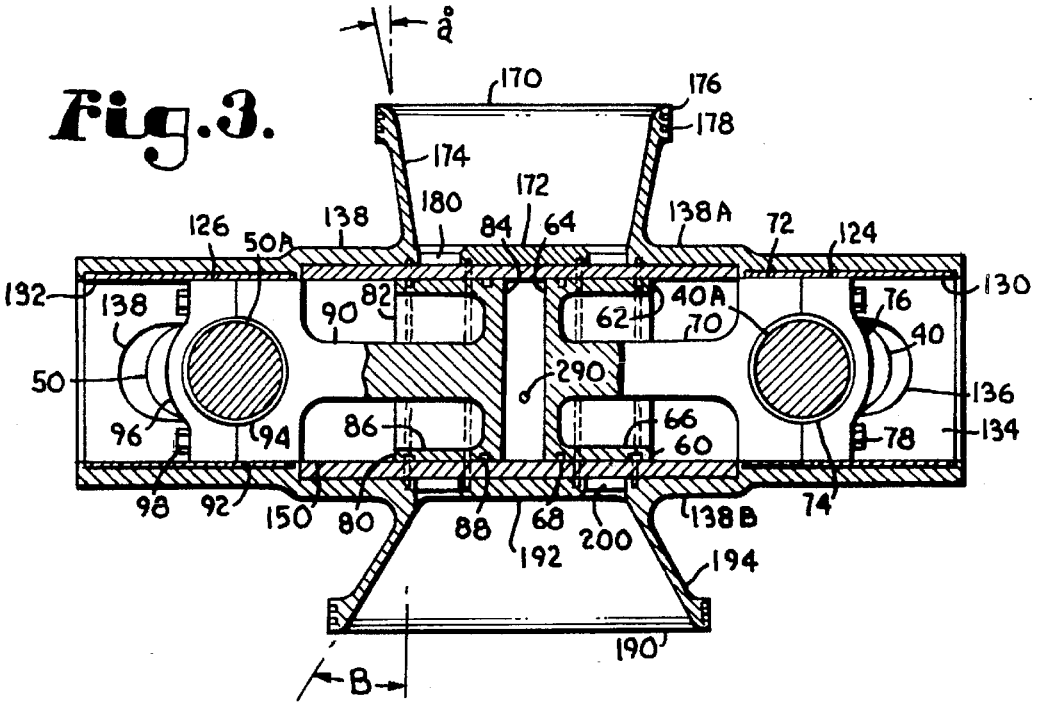
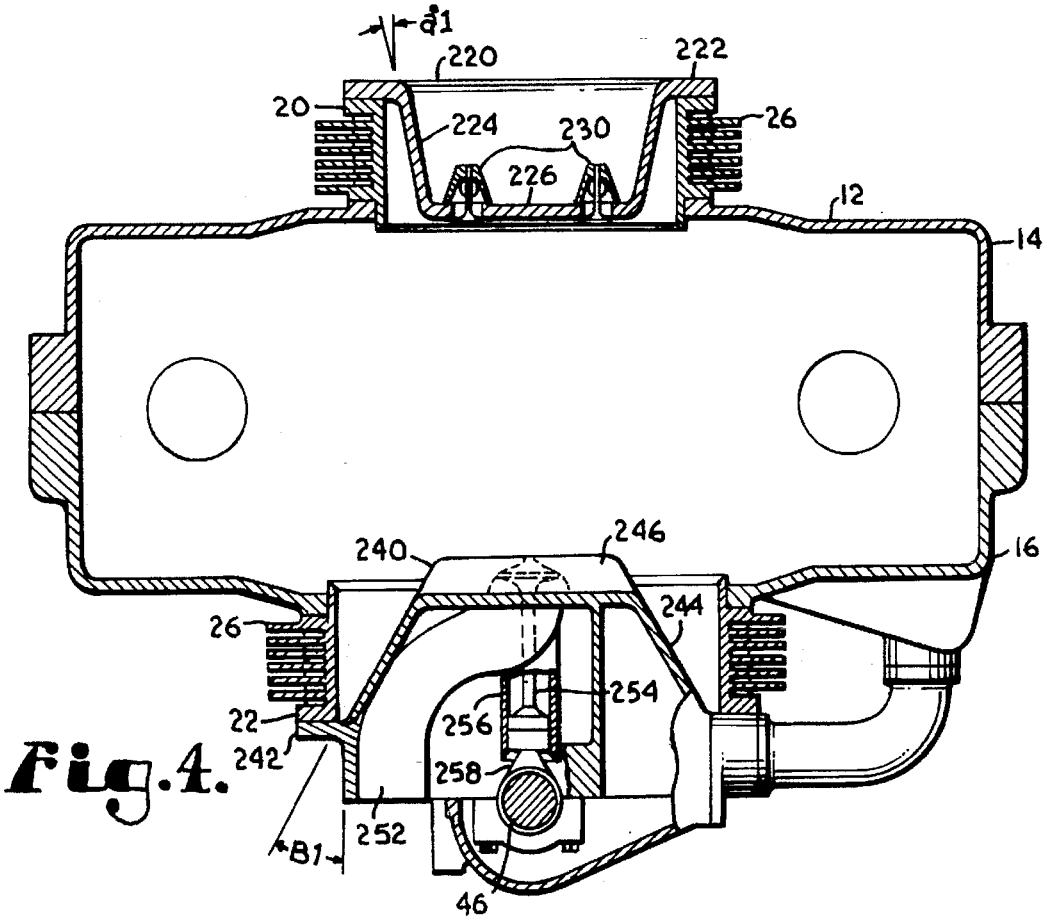
Fig.4.

Fig.7.
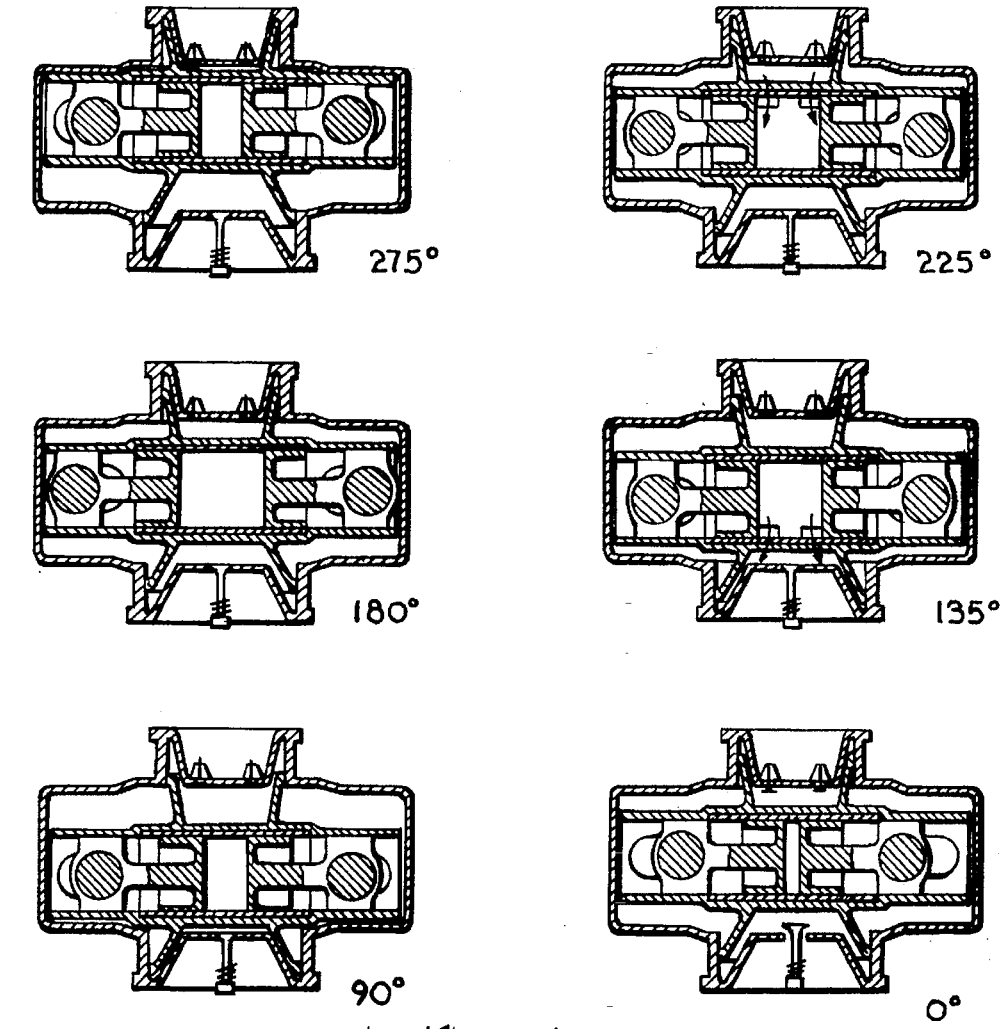
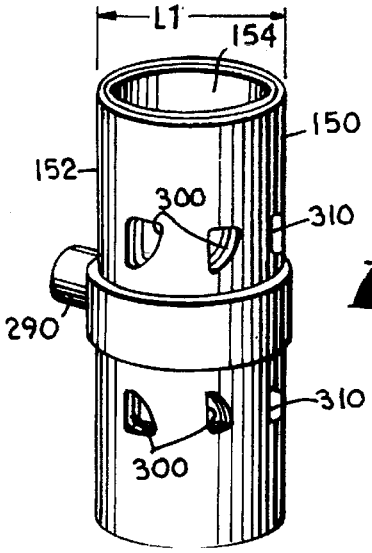
Fig.8.

DUAL COMPRESSION AND DUAL EXPANSION ENGINE

TECHNICAL FIELD

This invention generally pertains to internal combustion engines, and more particularly to piston-type internal combustion engines having multiple, cooperatively acting piston assemblies.

BACKGROUND ART

Internal combustion engines are well known to have properties and characteristics desirable for use as prime movers in various applications such as automotive and vehicular applications industrial machinery, and stationary power source applications. Several common configurations of the internal combustion engine include the turbine engine, for example, such as that found in the typical jet aircraft, the wankel-type engine, having a revolving piston, and occasionally found in automotive applications, and the reciprocating piston-type engine. The reciprocating piston-type internal combustion engine has been found to be adaptable and suitable for most common applications, including use in automobiles and trucks, industrial and construction machinery and as stationary power sources.

The reciprocating piston-type engine is typically found to operate in one of two thermodynamic cycles. The first is the Otto-cycle, typically burning a low-cetane fuel such as gasoline or kerosene, requiring an external system for spark-ignition of the fuel-air mixture in the engine to obtain combustion. The second is the Diesel-cycle in which combustion occurs spontaneously as a result of the compression of the fuel-air mixture. In practice, the lack of need for spark-ignition apparatus on the Diesel engine, coupled with the typically greater torque capability of the Diesel engine has rendered them suitable for use in those applications generally considered "heavy" or "rugged" duty, those being construction equipment, over-the-road trucks, railroad engines and agricultural equipment.

Additionally, reciprocating piston type Diesel engines have typically been physically larger and more massive than a comparable Otto-cycle engine, rendering the Diesel less suitable for applications where size and weight are primary considerations. This arises in part due to the nature of the respective cycles, in that the Diesel often operates at substantially higher compression ratios to obtain the compression required for ignition, with higher mechanical loads on the pistons, crankshaft and other components.

Other constraints are imposed by the size and timing of operation of the valves available to permit airflow into and out of the combustion chamber, the amount of compression available due to stroke length and bore diameter limitations in the typical piston assembly. For example, the common two-stroke engine provides one power stroke per crankshaft revolution, but has a limited ability to purge exhaust and charge the cylinder. On the other hand, the four stroke engine permits each cylinder to be purged of exhaust and fully charged prior to ignition, but can provide only one power stroke out of each two crankshaft revolutions. Additional external considerations, imposed in the form of concerns about particulate emissions, NOx emissions, and other pollutants, and costs of maintenance and operation, and manufacturability, often act as further limitations upon the performance of the typical reciprocating piston-type internal combustion engine.

Therefore, it is an object of the present invention to provide a dual compression and dual expansion engine which is simple to manufacture.

It is another object of the present invention to provide such a dual compression and dual expansion engine as may be readily manufactured by techniques and equipment consistent with those used in the manufacture of traditional reciprocating piston-type engines.

It is a further object of the present invention to provide such a dual compression and dual expansion engine as will have improved durability.

It is yet another object of the present invention to provide such a dual compression and dual expansion engine as may provide an improved power/weight ratio.

It is a further object of the present invention to provide such a dual compression and dual expansion engine as will be readily adaptable to use in those applications in which a traditional reciprocating piston diesel-type engine may be employed.

It is also an object of the present invention to provide such a dual compression and dual expansion engine as may suitably adapted for use in those applications in which the traditional Otto-cycle engine, such as the common reciprocating gasoline powered engine, may be employed.

It is yet a further object of the present invention to provide such a dual compression and dual expansion engine as will provide improved thermodynamic efficiency.

It is yet a further object of the present invention to provide such a dual compression and dual expansion engine as will provide improved control of pollutant emissions.

It is yet another object of the present invention to provide such dual compression and dual expansion engine as will be readily, simply, and inexpensively maintained.

These and other objectives of the present invention will become apparent in the specification and claims that follow.

SUMMARY OF THE INVENTION

The subject invention is a dual compression and dual expansion engine having a first compression chamber with a conical first piston reciprocatingly disposed therein, a combustion chamber assembly with two reciprocating, opposed pistons disposed in an oscillating valve sleeve therein to form a combustion chamber, the valve sleeve providing selective flow connection with the first compression chamber, and a second expansion chamber with a conical second piston reciprocatingly disposed therein in selective flow connection with the combustion chamber.

BRIEF DESCRIPTION OF THE DRAWINGS

FIG. 3 shows a partial cross-sectional view of the internal housing of the subject invention taken along section line 2—2 of FIG. 1.

FIG. 4 shows a partial cross-sectional view of the external housing of the subject invention taken along section line 2—2 of FIG. 1.

FIG. 7 shows a diagrammatic representation of the operating cycle of the subject invention.

FIG. 8 shows in isometric view the cylinder sleeve valve according to the subject invention.

DESCRIPTION OF THE PREFERRED EMBODIMENT

Figure 1:
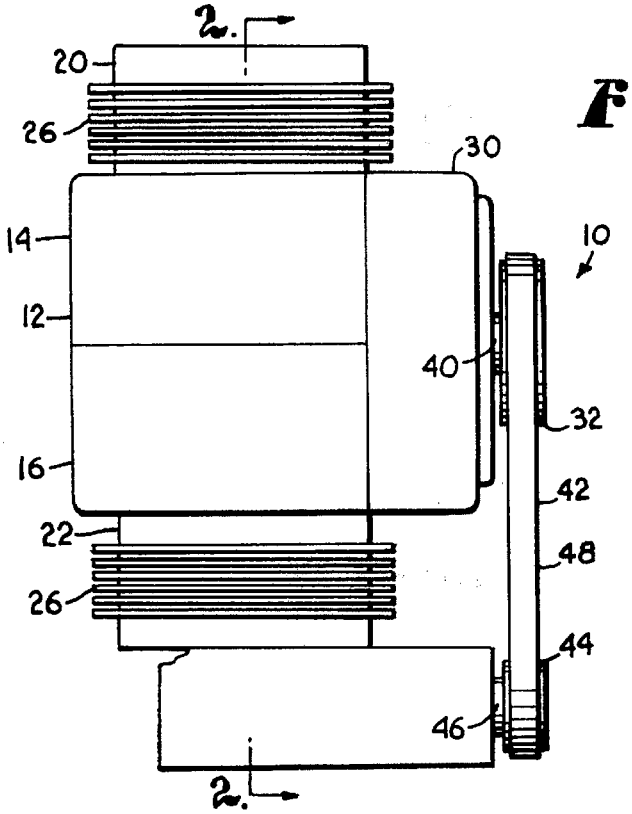
FIG. 1 shows an external isometric view of an engine according to the subject invention.

A dual compression and dual expansion internal combustion engine generally according to the present invention is shown in FIG. 1 and referred to with reference number 10. For purposes of this disclosure and the appended claims, FIG. 1 will be referred to as a "side view", with the subject invention disclosed as having a "horizontal axis of operation", an "upwardly disposed" intake on the "top", and a "downwardly disposed" exhaust on the "bottom". Those skilled in the relevant art will understand that these are directional references internal to the engine 10, given only for the purpose of aiding in the understanding of the engine 10 according to the subject invention. These internal directional references do not refer to the external orientation of the engine 10 and are not intended to and do not limit the engine 10 to any specific external orientation for operation.

Furthermore, sub-systems typically applicable to internal combustion engines and generally known in the art, such as air intake, cleaning and filtration systems, exhaust systems, lubricating and cooling systems, turbo- and super-charging systems, and transmission and final drive systems and the like, are not disclosed in conjunction with the subject invention. It is again anticipated that those skilled in the relevant arts will understand the applicability of these various sub-systems according to their respective design and operating parameters.

The engine 10 includes an external housing 12 preferably having an upper housing section 14 and a lower housing section 16. On the upper housing section 14 is disposed an upwardly directed first piston sleeve 20, and on the lower housing section 16 is disposed a downwardly directed second piston sleeve 22. The first piston sleeve 20 and the second piston sleeve 22 are preferably cylindrical, with vertical axes, and according to the preferred embodiment are co-axial. Further, the first piston sleeve 20 and the second piston sleeve 22 are each provided with cooling means in the form of annular, spaced apart cooling fins 26 at intervals along their respective exterior surfaces for providing ancillary cooling, although these may be replaced by liquid cooling jackets in alternative embodiments to ensure proper cooling. It must also be understood that the configuration of the external housing 12 is representative, and the external housing 12 may be enlarged so that both the first piston sleeve 20 and the second piston sleeve 22 may be disposed partially or entirely within the external housing 12, as the application of the engine 10 requires.

A phase gear housing 30 is disposed on the front of the external housing 12. A first drive shaft 40 extends horizontally through this phase gear housing 30, and a first timing pulley 32 is secured to the first crankshaft shaft 40. From this first timing pulley 32, a timing belt 42 engages a second timing pulley 44, secured to a rotationally mounted camshaft 46. The camshaft 46 is horizontal and parallel to the first crankshaft 40. The first timing pulley 32, timing belt 42, second timing pulley 44, and camshaft 46 together comprise an exhaust valve timing means 48.

Figure 2:
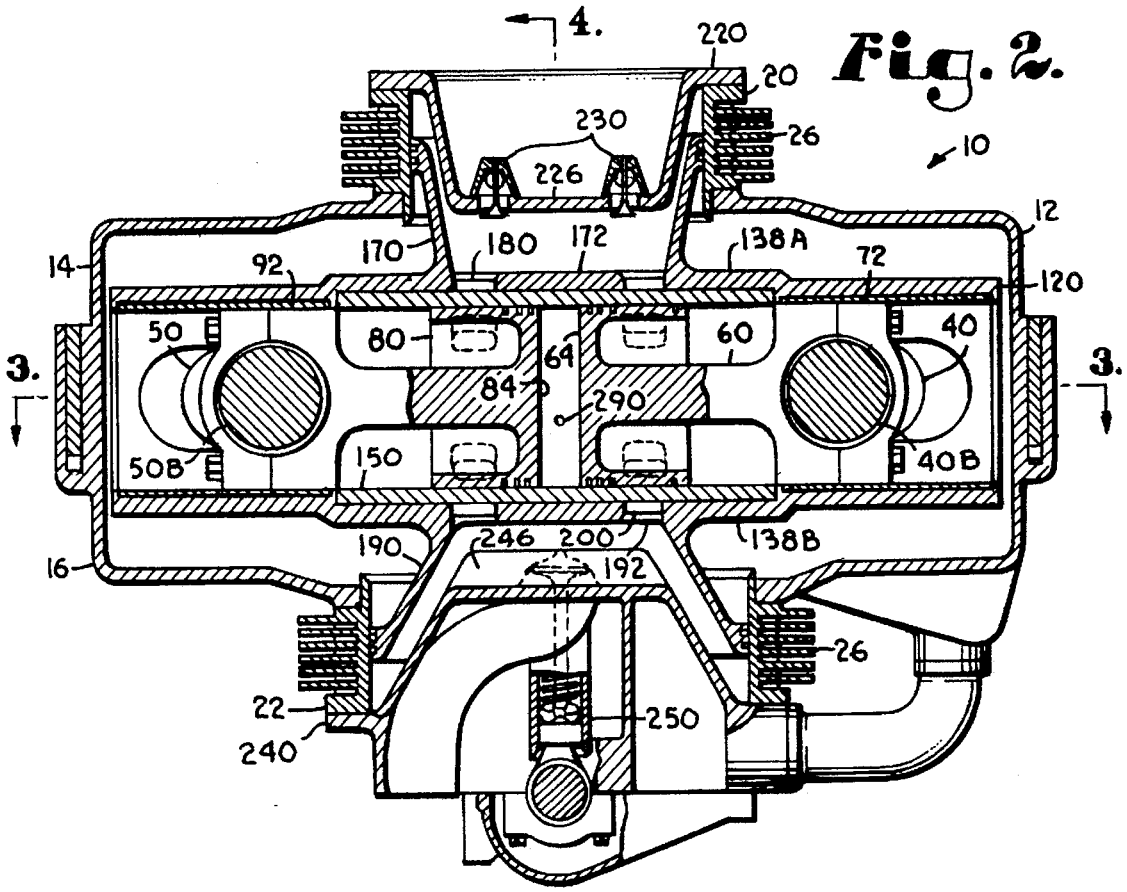
FIG. 2 shows a cross-sectional view of the subject invention taken along section line 2—2 of FIG. 1.

Turning then to FIGS. 2, 3, and 4, the subject invention is shown in greater detail. In FIG. 2 a cross-sectional view of the subject invention is shown, taken along Section lines 2—2 of FIG. 1. The internal housing 120, infra, is shown separately in FIG. 3, and the external housing 12 is shown separately in FIG. 4.

A second crankshaft 50 is disposed in the engine 10, parallel to and horizontally spaced apart from the first crankshaft 40. Also, respectively parallel to and horizontally spaced apart from the other respective crankshaft, the first crankshaft 40 has a first offset crank 40A, and the second crankshaft 50 has a second offset crank 50A. The first offset crank 40A is offset from the axis of rotation of the first crankshaft 40 by the measurement A from that axis of rotation, as the second offset crank 50A is likewise offset from the axis of rotation of the second crankshaft 50 by the measurement A.

A third piston member 60 operatively engages the first offset crank 40A and is disposed for reciprocating operation in the operating chamber of the internal housing 120. This third piston member 60 includes a third piston head 62 with a first combustion surface 64 at the distal end thereof, and a cylindrical third piston head land 66 with a number of piston rings 68, or at least one piston ring 68, disposed circumferentially thereabout for fluid control. A third piston connecting rod 70 connects the third piston head 62 to a third piston crank bearing assembly 72, which includes a third piston bearing 74 engaging the first bearing surface 40B of the first offset crank 40A for permitting load bearing rotation of the first offset crank 40A with respect to the third piston 60, a first bearing cap 76 for securing the third piston bearing 74 to the third piston crank bearing assembly 72 by way of securing bolts 78.

On the second offset crank 50A, a fourth piston member 80 is likewise operatively provided and also is disposed for reciprocating operation in the operating chamber of the internal housing 120. This fourth piston member 80 includes a fourth piston head 82 with a second combustion surface 84 at the distal end thereof, and a cylindrical fourth piston head land 86 with one or more parallel, spaced-apart piston rings 88 disposed circumferentially thereabout for fluid control. A fourth piston connecting rod 90 connects the fourth piston head 82 to a fourth piston crank bearing assembly 92, which includes a fourth piston bearing 94 about the second offset crank 50A for engaging the second bearing surface 50B of the second offset crank 50A to permit load bearing rotation thereof, a second bearing cap 96 for securing the second fourth piston bearing 94, and securing bolts 98.

The third piston assembly 60 and the fourth piston assembly 80 are operably disposed in an internal housing 120 which defines an operating chamber, and are disposed in the operating chamber such that the first combustion surface 64 and the second combustion surface 84 are each directed toward the other. The third piston crank bearing assembly 72 and the fourth piston crank bearing assembly 92 further include first and second carrier bearing surfaces 124 and 126, respectively. Each carrier bearing surface 124 and 126 includes a generally planar, horizontally disposed upper bearing face and lower bearing face. The first carrier bearing 124 slidingly engages a first internal housing bearing 130, and the second carrier bearing 126 slidingly engages a second internal housing bearing 132. Generally, the length of each of the internal housing bearings 130 and 132 is at least the length of a carrier bearing 124 or 126, plus twice the displacement A of the offset crank portions 40A or 50A. The distal ends of the internal housing 120 further includes internal housing sidewalls 134 in which is defined a first ovoidal slot 136 through which the first offset crank portion 40A freely passes, and a second ovoidal slot 138 through which the second offset crank portion 50A freely passes. The first and second ovoidal slots 136 and. 138 are adjacent to the first and second carrier bearings 124 and 126, respectively, and permit horizontal reciprocating, transverse motion of first and second offset crank portions 40A and 50A, which extend through the internal housing 120.

The first and second internal housing bearings 130 and 132 are disposed at the opposite distal ends of the operating chamber defined in the internal housing 120, as shown in FIGS. 2 and 3. The internal housing 120 further includes a substantially cylindrical center section 140 having an internal diameter L defined in the center of the operating chamber. Within this center section 140 of the internal housing 120 is disposed a cylinder sleeve valve 150, having a horizontal axis which intersects perpendicularly the axes of the first and second offset crank portions 40A and 50A. The cylinder sleeve valve 150 has an external diameter L1, substantially the same as the internal diameter L of the operating chamber, but with typical machining clearances so as to permit free rotation of the cylinder sleeve valve 150 about its axis. The cylinder sleeve valve 150 likewise has an internal diameter P1 which, with typical machining clearances, allows free reciprocation of the third and fourth piston members 60 and 80. A combustion chamber is defined in the operating chamber between the first combustion surface 64 and the second combustion surface 84 in the cylinder sleeve valve 150.

On the upper exterior surface 140A of the internal housing center section 140 is disposed an upwardly directed first piston member 170. The first piston member 170 has a base portion 172 which is semi-cylindrical about the axis of the cylinder sleeve valve 150, a frusto-conical first piston wall 174, and a cylindrical first piston exterior sleeve wall 176 at the distal, upper end of the piston wall 174. The angle $\dot{A}$ of the coni-form of the first piston wall 174 is such that the diameter of first piston wall 174 increases toward distal end thereof and the cylindrical first piston exterior sleeve wall (176) has a relatively larger diameter than said first piston base portion (172). A plurality of piston rings 178 of conventional design are disposed in accommodating annular grooves about the piston exterior sleeve wall 176 for sliding engagement with the first piston sleeve 20. The first piston base portion 172 further defines one or more valve windows 180 which communicate through to the cylinder sleeve valve 150. In the preferred embodiment, six first piston valve windows 180 are included.

Similarly, on the lower exterior surface 140B of the internal housing center section 140 is disposed an downwardly directed second piston member 190. The second piston member 190 has a second piston base portion 192 which is semi-cylindrical about the axis of the cylinder sleeve valve 150, a frusto-conical second piston wall 194, and a cylindrical second piston exterior sleeve wall 196 at the distal, lower end of the piston wall 194. The angle β of the coni-form of the second piston wall 194 is such that the diameter of second piston wall 194 increases toward distal end thereof. A plurality of piston rings 198 of conventional design are disposed in accommodating annular grooves about the piston lower sleeve wall 196 for sliding engagement with the second piston sleeve 22. The second piston base portion 192 further defines one or more valve windows 200 which communicate through to the cylinder sleeve valve 150. In the preferred embodiment, six second piston valve windows 200 are employed.

FIGS. 2 and 4 disclose the configuration of the external housing in more detail. The upwardly directed first piston sleeve 20 includes a first piston cylinder head 220 secured to the top, distal end thereof. This first piston cylinder head 220 is comprised of an annular end ring 222 for securing the first cylinder head 220 to the first piston sleeve 20, a first cylinder head wall 224, and a first cylinder head base portion 226. The first cylinder head wall 224 and first cylinder head base portion 226 are in substantial conformity with the first piston member 170. The first cylinder head wall 224 is frusto-conical in form, depending downwardly at an angle $\dot{a}1$ from the annular end ring 222, with the angle $\dot{a}1$ being substantially identical to, but slightly greater than, the angle $\dot{a}$ of the first piston wall 174 so as to conform thereto and yet provide some relief between the first piston wall 174 and the first cylinder head wall 224. Likewise, the first cylinder head base 226 is semi-cylindrical about a horizontal axis perpendicular to and removed a distance A above the axis of the first and second crankshafts 40 and 50, in conformity with the first piston base portion 172. In other words, for a centerline C taken perpendicularly through the axes of the first and second crankshafts 40 and 50, shown at Section Line 3—3 in FIG. 2, the base portion 172 of the first piston is generated about an axis of C+A, and the base portion 192 of the second piston is generated about an axis of C−A.

An intake valve means 230 is provided in the first cylinder head 220. As shown, this intake valve means 230 is comprised of one or more conventional pressure differential activated poppet-type valves. The intake valve means 230 may also be provided in the form of conventional reed-type valves, or if desired, conventional cam-driven or electrically operated valves may be employed. The intake valve means 230 preferably acts as a check-type valve for selectively permitting airflow through the first cylinder head 220 into the external housing 12 while preventing any flow from the external housing 12.

The downwardly directed second piston sleeve 22 includes a second piston cylinder head 240 secured to the bottom, distal end thereof. This second piston cylinder head 240 is comprised of an annular end ring 242 for securing the second cylinder head 240 to the second piston sleeve 22, a second cylinder head wall 244, and a second cylinder head base portion 246. The second cylinder head wall 244 and second cylinder head base portion 246 are in substantial conformity with the second piston member 190. The second cylinder head wall 244 is frusto-conical in form, extending upwardly at an angle β1 from the annular end ring 242, with the angle β1 being substantially identical to the angle β of the second piston wall 194 so as to provide some relief between the second piston wall 194 and the second cylinder head wall 244. Likewise, the second cylinder head base 246 is semi-cylindrical about a horizontal axis perpendicular to and removed a distance A below the axis of the second and second crankshafts 40 and 50, in conformity with the second piston base portion 192.

An exhaust valve means 250 is provided in the second cylinder head 240. This exhaust valve means 250 directs exhaust fluids to the exhaust passage 252 and is comprised of one or more conventional cam-operated valves, exemplified by the exhaust valve 254, the valve lifter assembly 256, the exhaust valve cam 258 and camshaft 46. The exhaust valve cam 258 is secured to, or integral with, camshaft 46, and operates the valve lifter assembly 256 and the exhaust valve 254 in response to the rotation of the camshaft 46. The exhaust valve timing means 48 rotates the camshaft 46 at the angular speed required to actuate the exhaust valve 254 at the proper time and for the proper duration to exhaust the combustion gases from the engine 10.

Both the intake valve means 230 and the exhaust valve means 250 are disclosed in exemplified form since such valve types are considered well known in the relevant art, and it is believed that those skilled in the art will be able to readily select the appropriate valve type. Furthermore, those skilled in the art will understand that the number, size and types of valves to be employed will vary in accordance with such parameters as the fluid mass flow rate desired, power output desired from the engine 10, and the speed at which the engine 10 may be operated in a selected application.

Figure 5:
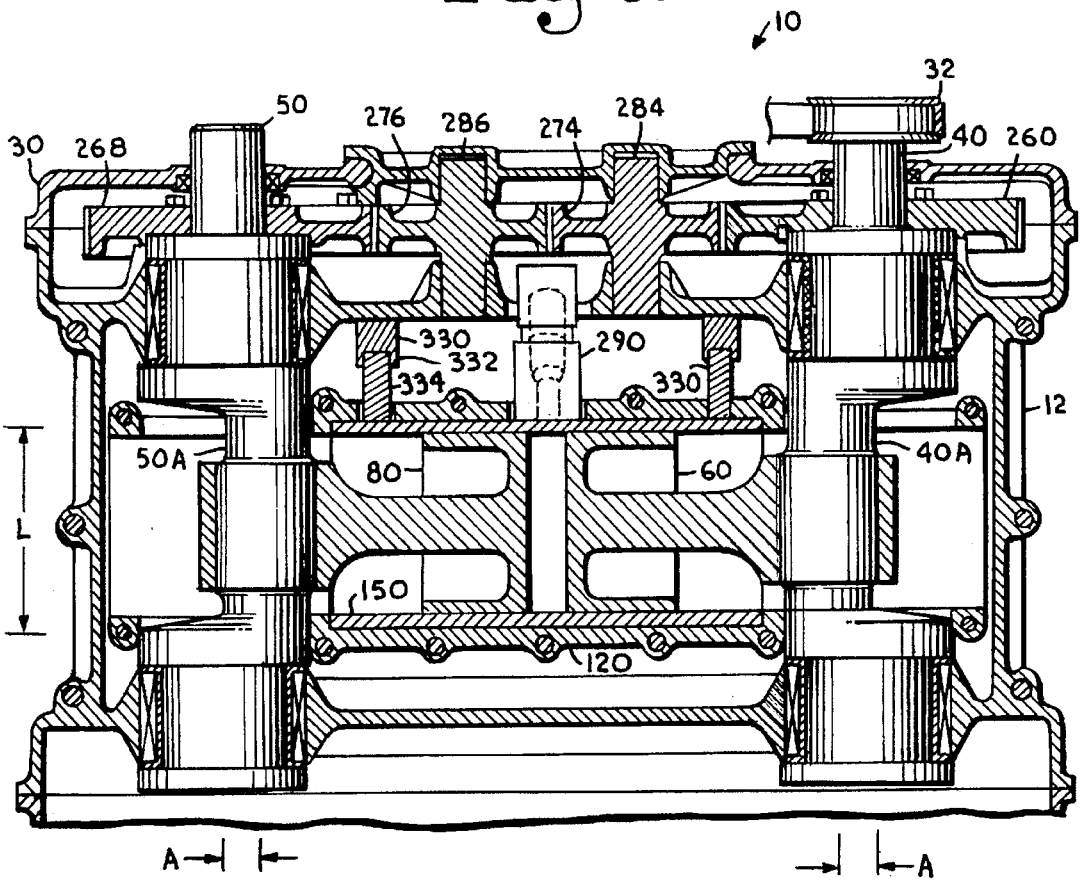
FIG. 5 shows a cross-sectional view of the subject invention taken along section line 3—3 of FIG. 2.

FIG. 5 discloses a sectional view of the engine 10, taken through the axes of the first and second crankshafts 40 and 50, respectively. In this view, the first crankshaft 40 is shown to include a crankshaft bearing portion 40B adjacent each end of the first offset crank portion 40A. Each first crankshaft bearing portion 40B is rotatably supported in a conventional bearing means such as a journal bearing (shown), or a roller-type or other bearing, fixed in the external housing 12. Likewise, the second crankshaft 50 is shown to include a crankshaft bearing portion 50B adjacent each end of the second offset crank portion 50A. Each second crankshaft bearing portion 50B is rotatably supported in a conventional bearing means such as a journal bearing (shown) or other bearing fixed in the external housing 12.

As noted in FIG. 1, the first crankshaft 40 extends through the phase gear housing 30, as does the second crankshaft 50. Within the phase gear housing 30, a crankshaft phasing means 260 is contained. This crankshaft phasing means 260 assures that the first crankshaft 40 and the second crankshaft 50 rotate synchronously, but in opposite directions of rotation. According to the preferred embodiment, this crankshaft phasing means 260 includes a first phase gear 264 secured to the first crankshaft 40 within the phase gear housing 30, and a second phase gear 268 secured to the second crankshaft 50 within the phase gear housing 30. A first idler gear 274 and a second idler gear 276 are disposed within the phase gear housing 30 and comprise a part of the crankshaft phasing means 260. The first idler gear 274 is secured to a first idler shaft 284 and the second idler gear 276 is secured to a second idler shaft 286, and both of these shafts are rotationally mounted within the phase gear housing 30. Each of these gears are provided with conventional gear teeth about the circumference thereof. The first idler shaft 284 is parallel to and spaced apart from the first crankshaft 40 such that first phase gear 264 is in contact with the first idler gear 274. The second idler shaft 286 is parallel to and spaced apart from the first idler shaft 284 and the second crankshaft 50 such that the first idler gear 274 is in contact with the second idler gear 276, and the second idler gear is in turn in contact with the second phase gear 268 so as to form a gear train. As those skilled in the art will appreciate, these respective gears are in pitch circle contact and they are constrained to rotate synchronously, and the first and second crankshafts 40 and 50 will rotate in opposite directions. Alternatively, of course, larger first and second phase gears 264 and 268 may be used without the need for any intermediate first and second idler gears 274 and 276.

Figure 6:
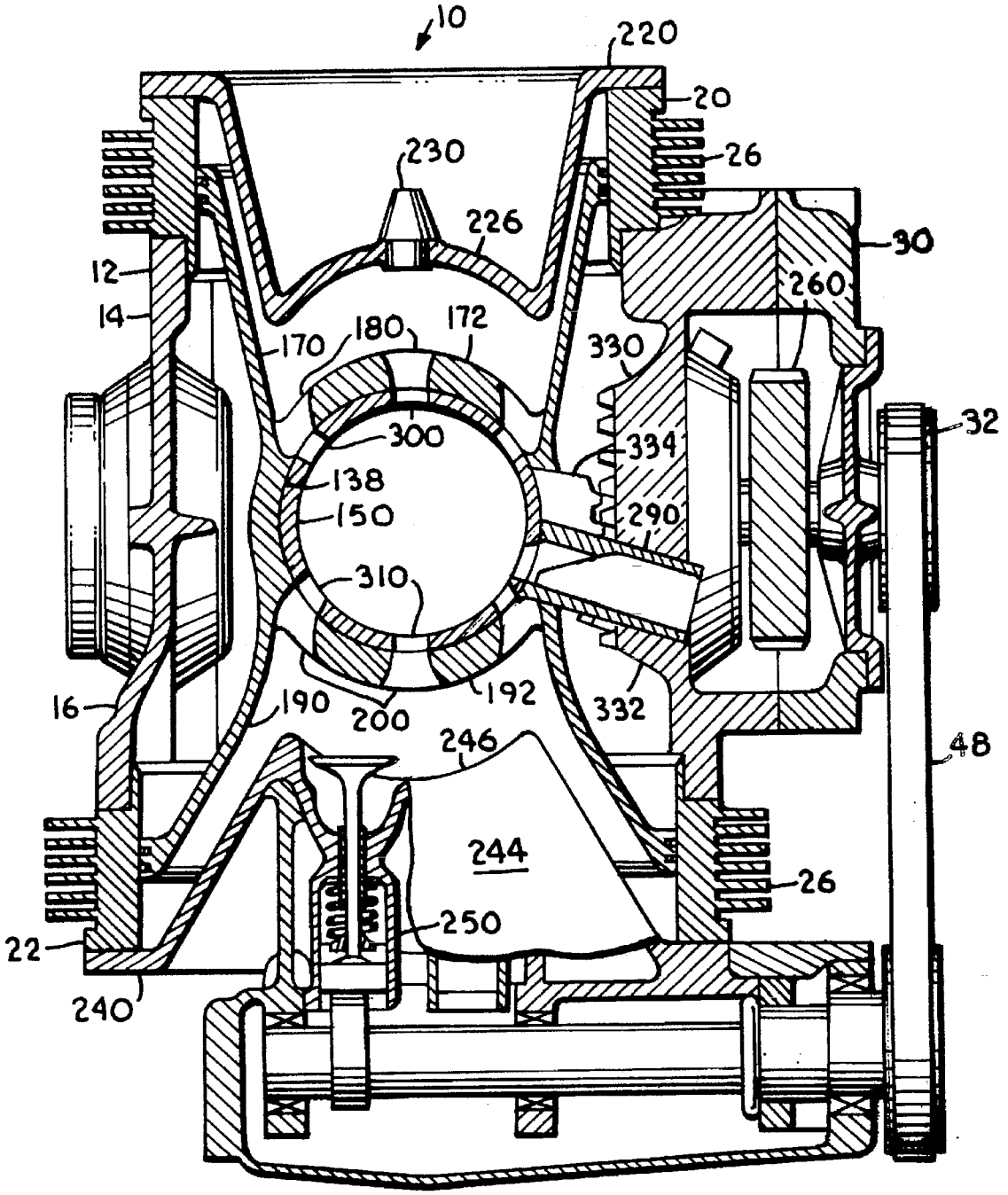
FIG. 6 shows a cross-sectional view of the subject invention taken along section line 4—4 of FIG. 2.

The cylinder sleeve valve 150 can be seen in more detail in FIGS. 5, 6 and 8. A fuel injection means 290 is disposed on the cylinder sleeve valve 150 in a central position so as to enable the injection of fuel into the combustion chamber in the interior of the cylinder sleeve valve 150. The fuel injection means 290 itself is mounted on the outside of the cylinder sleeve valve 150, extending perpendicularly from the axis thereof. The fuel injection means 290 is not shown in detail, nor is the piping for fuel delivery to the fuel injection means 290. These are both believed to be well understood by those skilled in the relevant art.

The cylinder sleeve valve 150 may be a unitary construction, but is preferably comprised of a cylindrical exterior sleeve element 152 and a corresponding cylindrical interior sleeve element 154. According to the preferred embodiment, a void may be defined between the exterior sleeve element 152 and the interior sleeve element 154, into which a flow of cooling fluid may be directed to lower the temperature of the cylinder sleeve valve 150 during operation. Furthermore, dissimilar materials may be used for the exterior sleeve element 152 and the interior sleeve element 154. Preferably, the exterior sleeve element 152 is steel, providing improved structural strength, while the interior sleeve element 154 may be cast iron or ceramic to provide improved wear and thermal characteristics to the operating chamber.

According to the preferred embodiment, the cylinder sleeve valve 150 includes one or more, and preferably six, sleeve intake windows 300 and one or more, and preferably six sleeve exhaust windows 310. As can be seen in FIGS. 2, 3, 6, and 7, these respective windows 300 and 310 are positionally spaced apart both along the axis of the cylinder sleeve valve 150 and angularly about that axis. The sleeve intake windows 300 cooperate with the respective first piston valve windows 180 to selectively permit and prevent fluid communication into the operating chamber, while the sleeve exhaust windows 310 cooperate with the respective second piston valve windows 180 to selectively permit and prevent fluid communication out of the operating chamber.

A sleeve oscillating means 330, shown more clearly in FIGS. 5 and 6, is provided for rotationally oscillating the cylinder sleeve valve 150 to cause timed, selected rotational positioning of the cylinder sleeve valve 150 in response to changes in position of the internal housing 120 within the external housing 12. This sleeve oscillating means 330 includes at least one rack gear 332 affixed to the internal wall of external housing 12, with conventional gear teeth extending inwardly toward the internal housing 120. A gear sector 334 integral to the cylinder sleeve valve 150 extends through a suitable opening in the internal housing 120 toward the rack gear 332, with conventional gear teeth thereon extending toward the external housing 12 and engaging the teeth of the rack gear 332.

Preferably, the engine 10 is constructed of materials found suitable in typical engine applications. Those skilled in the relevant art will recognize that the selected materials will depend upon a variety of factors. For example, where the engine 10 is to be used in industrial applications the preferred material would primarily be steel, with cast iron being used in the first and second piston sleeves 20 and 22 and in the cylinder sleeve valve 150. On the other hand, for limited life applications where weight and not durability a principal factor, composite materials and plastics may be used.

Turning then to FIG. 7, the operation of the engine 10 may be followed through one cycle by following the degrees of (counterclockwise) rotation of the first crankshaft 40 as indicated in the Figure. The diesel cycle of operation will be described for the engine 10, although those skilled in the relevant art will readily understand that the intake air may be an air-fuel mixture, and that the fuel injection means 290 may be replaced by a spark ignition apparatus. The degrees of rotation selected are representative and for purposes of description. The events described as occurring at 135 and 225 degrees, respectively, are required for the proper operation of the engine 10, but need not occur at that particular point of rotation. The events preferably occurring at 135 degrees should occur between 0 and 180 degrees, and those preferably at 225 degrees between 180 and 360 degrees.

At 0 degrees of rotation, the third piston member 60 and the fourth piston member 80 have moved toward each other within the cylinder sleeve valve 150 to bring the combustion chamber to its minimum volume. At this point in the cycle combustion occurs in the combustion chambers, forcibly acting upon the third piston member 60 and the fourth piston member 80. The piston members in turn act upon their respective first and second crankshafts 40 and 50 to cause rotation thereof, from which usable power may be derived. As the crankshafts 40 and 50 rotate from 0 degrees, the internal housing is carried downward, causing a reduction in pressure in the first compression chamber defined in the first piston sleeve 20 between the first piston member 170 and the first cylinder head 220, causing the intake valve means 230 and permitting the induction of air into the low pressure intake chamber. At the same time the exhaust valve means 250 is maintained by the exhaust valve cam 258 to the open position, permitting the outflow of exhaust gases from the second expansion chamber defined in the second piston sleeve 22 between the second piston member 190 and the second cylinder head 240. As the crankshafts 40 and 50 rotate to carry the internal housing downward, the volume in the second expansion chamber is reduced and the exhaust gases are purged therefrom. It will be noted that the reciprocation of internal housing translates to a vertical axis, perpendicular to the horizontal axes of the first and second crankshafts 40 and 50, about which both the first piston sleeve 20 and the second piston sleeve 22 are generated.

At the 90 degree crankshaft position, the volume of the first compression chamber has reached its maximum and induction into the first compression chamber has ceased. At this point, pressure in the first compression chamber is equal to ambient air pressure, and the intake valve means 230 closes. Expansion of the combusted gases in the combustion chamber continues. The volume within the second expansion chamber has reached its minimum, and the exhaust valve means 250 is permitted to close.

At 135 degrees, the piston members 60 and 80 have traveled within the cylinder sleeve valve 150 and exposed the six sleeve exhaust windows 310 in the cylinder sleeve valve 150. At this point the sleeve oscillating means 330 is selectively timed and has rotated the cylinder sleeve valve 150 such that the sleeve exhaust windows 310 are aligned with the cooperating second piston valve windows 200, permitting a flow of the combustion gases from the combustion chamber into the second expansion chamber, while flow is prevented to the first compression chamber as the sleeve intake windows 300 are not aligned with the first piston valve windows 180. The volume of the second expansion chamber is increasing as the internal housing 120 moves upward, and continued expansion of the combustion gases occurs in this chamber, exerting force on the second piston member 190 which is transferred to the crankshafts 40 and 50 by way of the internal housing bearings 130 and 132 and the carrier bearings 124 and 126, respectively. At this time, because the volume in the first compression chamber is decreasing, the air therein is undergoing compression.

At 180 degrees, the sleeve oscillating means 330 has further rotated the cylinder sleeve valve 150 such that the sleeve exhaust windows 310 are no longer aligned with the cooperating second piston valve windows 200, preventing a flow of the combustion gases into the second expansion chamber. Expansion of combustion gases is continuing in the second expansion chamber, and compression of intake air is continuing in the first compression chamber. The first and second piston members 60 and 80 are at their maximum travel and the combustion chamber is at maximum volume.

At 225 degrees, expansion of combustion gases continues in the second expansion chamber, and the sleeve oscillating means 330 is selectively timed and has rotated the cylinder sleeve valve 150 such that the sleeve intake windows 300 are aligned with the cooperating first piston valve windows 180, permitting a flow of the now compressed intake air into the combustion chamber from the first compression chamber, and preventing any communication to the second expansion chamber as the sleeve exhaust windows 310 are not aligned with the second piston valve windows 200.

At 275 degrees of rotation, the expansion of combustion gases in the second expansion chamber is completed and the second expansion chamber is at its maximum volume. The sleeve oscillating means 330 has rotated the cylinder sleeve valve 150 such that the sleeve intake windows 300 are no longer aligned with the cooperating first piston valve windows 180, preventing any flow of the intake air from the combustion chamber. The combustion chamber now acts as a second compression chamber, compressing the intake air further as the rotation continues toward 0 degrees of rotation. Also at this position, the exhaust valve means 250 is activated by the exhaust valve cam 258 to the open position, permitting the outflow of exhaust gases from the second expansion chamber as the volume of the second expansion chamber begins to decrease. Similarly, the volume of the first compression chamber is at its minimum at this position, and the induction of intake air will begin as the rotation continues past this point toward 90 degrees rotation.

Figure 6A:
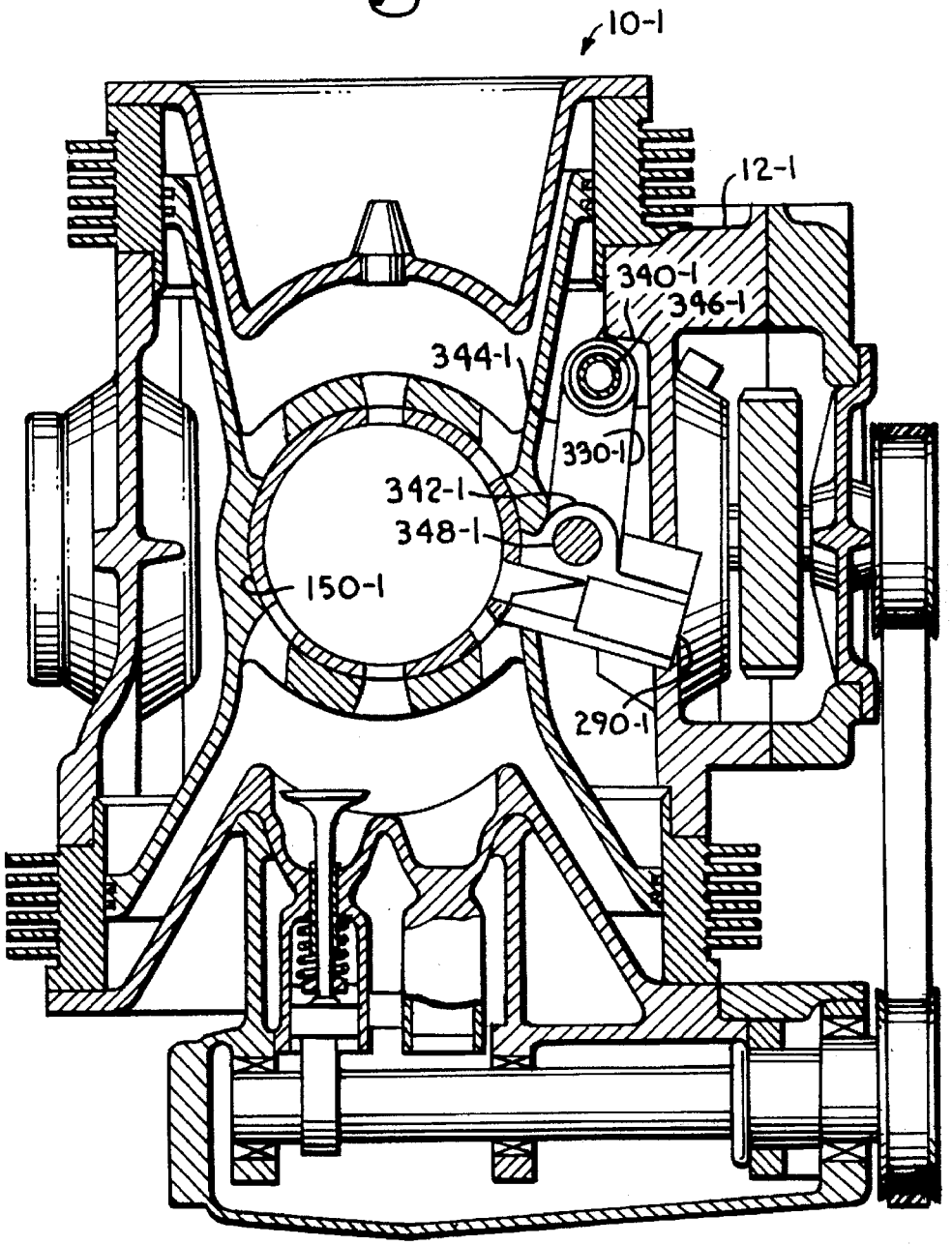
FIG. 6A shows a cross-sectional view of an alternative embodiment of the subject invention in which an alternative sleeve oscillating means is employed, again taken along section line 4—4 of FIG. 2.

An alternative embodiment of the sleeve oscillating means 330 is disclosed in an engine 10-1 in FIG. 6A. It should be noted that when the same item or feature is shown in more than one embodiment, it will be labeled with the corresponding reference numeral and a suffix to aid in the understanding of the subject invention. The alternative embodiment of the sleeve oscillating means 330 (330-1) includes a first boss 340-1 affixed to the external housing 12-1 and a second boss 342-1 affixed to the cylinder sleeve valve 150-1, preferably to the fuel injector means 290-1 to minimize the number of openings through the internal housing 120. A sleeve link 344-1 extends between the first boss 340-1 and the second boss 342-1. A first link pin 346-1 pivotally secures the sleeve link 344-1 to the first boss 340-1, and a second link pin 348-1 pivotally secures the sleeve link 344-1 to the second boss 342-1.

In operation, the alternative embodiment produces the same oscillating action in the cylinder sleeve valve 150 as that produced by the preferred embodiment. The second boss 342-1 is constrained to rotate about the axis of the cylinder sleeve valve 150-1 in the manner of a crank while the sleeve link 344-1 acts as a link to constrain the degree of rotation thereof relative to the first boss 340-1.

Figure 9:
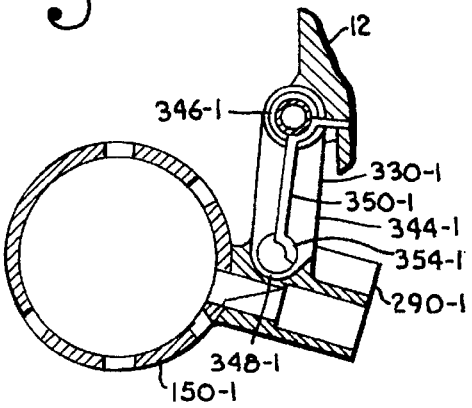
FIG. 9 shows a partial cross-sectional view of the alternative sleeve oscillating means as shown in FIG. 6A.

Preferably, the sleeve link 344-1 is defines at least one interior void or fluid passage 350-1 from the first boss 340-1 to the second boss 342-1. In this way, fluid such as fuel or coolant may be supplied to the second boss 342-1 from the first boss 340-1. A first flow passage 352-1 in the first link pin 346-1 permits fluid flow to the fluid passage 350-1 and a second flow passage 354-1 in the second link pin 348-1 permits fluid flow to the fluid passage 350-1 This void or fluid passage is shown in more detail in FIG. 9, which is a partial cross-sectional view of the alternative embodiment of the sleeve oscillating means 330-1.

Several substantial advantages over the prior art are seen in the engine 10. For each rotation of the crankshafts 40 and 50, induction of intake air occurs for up to 180 degrees, so that a substantial charge of air is available. Secondly, a long power stroke is provided from 0 degrees up to 270 degrees, depending upon valve timing. Also, the use of circular pistons permits the use of commonly known machining tools and methods to accomplish the manufacture of the engine 10, and maximizes the use of readily available components such as annular piston rings, for example, and standard fuel injection equipment. The cylinder sleeve valve 150 fulfills the function of both the cylinder sleeve in which the third and fourth piston members 60 and 80 operate, and, oscillating rotationally in response to the sleeve oscillating means, acts as the valve to control the timing of fluid transfer into and out of the combustion chamber, eliminating the need for additional valve mechanisms. The need for additional valve controlling and timing mechanisms is also eliminated. In addition, while the engine 10 is for convenience described herein as having horizontally disposed first and second crankshafts 40 and 50, the engine 10 can be designed to operate in any orientation. Furthermore, mechanical loads are substantially reduced as compared to a typical reciprocating piston-type engine. For example, the loads due to combustion are sub-divided to the two crankshafts 40 and 50 and also to the components of the second expansion chamber.

There are alternative embodiments and modifications of the subject invention which may be devised by those skilled in the relevant art within the scope and spirit of the description and the claims following.

I claim:

1. An internal combustion engine comprised of:

an external housing having a cylindrical, upwardly disposed first piston sleeve and a cylindrical downwardly disposed second piston sleeve; and an internal housing disposed in said external housing, said internal housing including a center section defining an operating chamber and further having an upwardly disposed firs piston member in reciprocating engagement with said first piston sleeve and a downwardly disposed second piston member in reciprocating engagement with said second piston sleeve, said first piston member including a first piston base portion including a first piston valve window.

2. The internal combustion engine as set forth in claim 1 wherein said first piston base portion further includes a plurality of first piston valve windows communicating to said operating chamber.

3. The internal combustion engine as set forth in claim 1 wherein said cylindrical first piston exterior sleeve wall has a relatively larger diameter than said first piston base portion.

4. The internal combustion engine as set forth in claim 3 wherein said frusto-conical first piston wall has a frusto-coniform of angle $\dot{a}$.

5. An internal combustion engine comprised of:

an external housing having a cylindrical, upwardly disposed firs piston sleeve and a cylindrical downwarly disposed second piston sleeve; and an internal housing disposed in said external housing said internal housing including a center section defining an operating chamber and further having an upwardly disposed first piston member in reciprocating engagement with said first piston sleeve, said first piston member further including a frusto-conical first piston wall, and a downwardly disposed second piston member in reciprocating engagement with said second piston sleeve.

6. The internal combustion engine as set forth in claim 5 wherein said first piston member further includes a cylindrical first piston exterior sleeve wall at a distal end thereof.

7. The internal combustion engine as set forth in claim 6 wherein said cylindrical first piston exterior sleeve wall further includes a piston ring disposed in a corresponding annular groove therein.

8. The internal combustion engine as set forth in claim 5 wherein said second piston member further includes a frusto-conical second piston wall.

9. The internal combustion engine as set forth in claim 8 wherein said first piston sleeve has a top, distal end with a first piston cylinder head secured thereto.

10. The internal combustion engine as set forth in claim 9 wherein said first piston cylinder head further includes a first cylinder head wall and a first cylinder head base portion.

11. The internal combustion engine as set forth in claim 10 wherein said first cylinder head wall is frusto-conical and substantially conforms to the first piston wall.

12. The internal combustion engine as set forth in claim 11 wherein said first cylinder head wall is frusto-conical at an angle $\dot{a}1$ which is slightly greater than the angle $\dot{a}$ of the first piston wall to provide relief between said walls.

13. The internal combustion engine as set forth in claim 12 wherein said first cylinder head further includes an intake valve means for selectively permitting airflow through the first cylinder head into the external housing 12 while preventing any flow therefrom.

14. The internal combustion engine as set forth in claim 13 wherein said intake valve means includes a pressure differentially activated valve.

15. The internal combustion engine as set forth in claim 5 wherein said second piston member further includes a cylindrical second piston exterior sleeve wall at a distal end thereof.

16. The internal combustion engine as set forth in claim 15 wherein said cylindrical second piston exterior sleeve wall further includes a piston ring disposed in a corresponding annular groove therein.

17. The internal combustion engine as set forth in claim 16 wherein said second piston member further includes a second piston base portion.

18. The internal combustion engine as set forth in claim 17 wherein said second piston base portion further includes a second piston valve window.

19. The internal combustion engine as set forth in claim 18 wherein said second piston base portion further includes a plurality of second piston valve windows communicating to said operating chamber.

20. The internal combustion engine as set forth in claim 19 wherein said cylindrical second piston exterior sleeve wall has a relatively larger diameter than said second piston base portion.

21. The internal combustion engine as set forth in claim 20 wherein said frusto-conical second piston wall has a frusto-coniform of angle $\beta$.

22. The internal combustion engine as set forth in claim 21 wherein said second piston sleeve has a bottom, distal end with a second piston cylinder head secured thereto.

23. The internal combustion engine as set forth in claim 22 wherein said second piston cylinder head further includes a second cylinder head wall and a second cylinder head base portion.

24. The internal combustion engine as set forth in claim 23 wherein said second cylinder head wall is frusto-conical and substantially conforms to the second piston wall.

25. The internal combustion engine as set forth in claim 24 wherein said second cylinder head wall is frusto-conical at an angle $\beta 1$ which is slightly greater than the angle $\beta$ of the second piston wall to provide relief between said walls.

26. The internal combustion engine as set forth in claim 25 wherein said second cylinder head further includes an exhaust valve means for selectively permitting airflow through the second cylinder head from the external housing 12 while preventing any flow therefrom.

27. The internal combustion engine as set forth in claim 26 wherein said exhaust valve means includes an exhaust valve, a valve lifter assembly, and an exhaust valve cam secured to a rotationally mounted camshaft.

28. The internal combustion engine as set forth in claim 27 wherein said engine further includes an exhaust valve timing means.

29. An internal combustion engine comprised of:

an external housing having a cylindrical, upwardly disposed first piston sleeve and a cylindrical downwardly disposed second piston sleeve;

an internal housing disposed in said external housing, said internal housing defining an operating chamber and further having an upwardly disposed first piston member in reciprocating engagement with said first piston sleeve, and a downwardly disposed second piston member in reciprocating engagement with said second piston sleeve;

a horizontally disposed first crankshaft; and parallel, horizontally disposed second crankshaft spaced apart from said first crankshaft.

30. The internal combustion engine as set forth in claim 29 wherein said first crankshaft further includes a first offset crankshaft portion and said second crankshaft further includes a second offset crankshaft portion.

31. The internal combustion engine as set forth in claim 30 wherein said first offset crankshaft portion is offset by a distance A from the axis of the first crankshaft and said second offset crankshaft portion is offset by a distance A from the axis of the second crankshaft.

32. The internal combustion engine as set forth in claim 31 wherein said internal housing further includes internal housing sidewalls at distal ends of the internal housing.

33. The internal combustion engine as set forth in claim 32 wherein said internal housing sidewalls further define a first ovoidal slot through which the first offset crank portion passes freely.

34. The internal combustion engine as set forth in claim 32 Wherein said internal housing sidewalls further define a second ovoidal slot through which the second offset crank portion passes freely.

35. The internal combustion engine as set forth in claim 31 wherein said engine further includes a crankshaft phasing means.

36. The internal combustion engine as set forth in claim 35 wherein said crankshaft phasing means further includes a first phase gear secured to the first crankshaft and a second phase gear secured to the second crankshaft.

37. The internal combustion engine as set forth in claim 36 wherein said crankshaft phasing means further includes a first idler gear secured to a first idler shaft and a second idler gear is secured to a second idler shaft, said first idler gear in contact with said first phase gear and said second idler gear in contact with said first idler gear and said second phase gear to form a gear train.

38. The internal combustion engine as set forth in claim 37 wherein said external housing further includes a phase gear housing in which the crankshaft phasing means is contained.

39. The internal combustion engine as set forth in claim 31 wherein the center section of said internal housing is a cylinder having an internal diameter L.

40. The internal combustion engine as set forth in claim 39 wherein the center section of said internal housing further includes a cylinder sleeve valve disposed therein.

41. The internal combustion engine as set forth in claim 40 wherein said cylinder sleeve valve is cylindrical with an external diameter L1 about the axis of the cylinder sleeve valve, where the diameter L1 is less than the diameter L of the center section.

42. The internal combustion engine as set forth in claim 41 wherein said cylinder sleeve valve further includes a sleeve intake window.

43. The internal combustion engine as set forth in claim 41 wherein said cylinder sleeve valve further includes a plurality of sleeve intake windows, said sleeve intake windows spaced-apart positionally and angularly about the axis of the diameter L1, and said sleeve intake windows cooperating with the respective first piston valve windows.

44. The internal combustion engine as set forth in claim 43 wherein said cylinder sleeve valve further includes a sleeve exhaust window.

45. The internal combustion engine as set forth in claim 44 wherein said cylinder sleeve valve further includes a plurality of sleeve exhaust windows, said sleeve exhaust windows spaced-apart positionally and angularly about the axis of the diameter L1, and said sleeve exhaust windows cooperating with the respective second piston valve windows.

46. The internal combustion engine as set forth in claim 41 wherein said internal housing further includes a third piston member and a fourth piston member disposed in said operating chamber.

47. The internal combustion engine as set forth in claim 46 wherein said third piston member further includes a third piston head.

48. The internal combustion engine as set forth in claim 47 wherein said third piston head further includes a first combustion surface at the distal end thereof.

49. The internal combustion engine as set forth in claim 48 wherein said third piston head further includes a cylindrical third piston head land.

50. The internal combustion engine as set forth in claim 49 wherein said cylindrical third piston head land includes a piston ring disposed circumferentially thereabout for fluid control.

51. The internal combustion engine as set forth in claim 50 wherein said third piston member further includes a third piston crank bearing assembly.

52. The internal combustion engine as set forth in claim 51 wherein said third piston crank bearing assembly further includes a third piston bearing engaging the first offset crank for permitting load bearing rotation of the first offset crank with respect to the third piston.

53. The internal combustion engine as set forth in claim 52 wherein said third piston further includes a third piston connecting rod for connecting the third piston head to the third piston crank bearing assembly.

54. The internal combustion engine as set forth in claim 53 wherein said third piston crank bearing assembly further includes an first carrier bearing.

55. The internal combustion engine as set forth in claim 54 wherein said first carrier bearing further includes a generally planar, horizontally disposed upper bearing face and lower bearing face.

56. The internal combustion engine as set forth in claim 55 wherein said internal housing further includes a first internal housing bearing in sliding engagement with said first carrier bearing.

57. The internal combustion engine as set forth in claim 53 wherein said fourth piston member further includes a fourth piston head.

58. The internal combustion engine as set forth in claim 57 wherein said fourth piston head further includes a first combustion surface at the distal end thereof.

59. The internal combustion engine as set forth in claim 58 wherein said fourth piston head further includes a cylindrical fourth piston head land.

60. The internal combustion engine as set forth in claim 59 wherein said cylindrical fourth piston head land includes a piston ring disposed circumferentially thereabout for fluid control.

61. The internal combustion engine as set forth in claim 60 wherein said fourth piston member further includes a fourth piston crank bearing assembly.

62. The internal combustion engine as set forth in claim 61 wherein said fourth piston crank bearing assembly further includes a fourth piston bearing engaging the first offset crank for permitting load bearing rotation of the first offset crank with respect to the fourth piston.

63. The internal combustion engine as set forth in claim 62 wherein said fourth piston further includes a fourth piston connecting rod for connecting the fourth piston head to the fourth piston crank bearing assembly.

64. The internal combustion engine as set forth in claim 63 wherein said fourth piston crank bearing assembly further includes a second carrier bearing.

65. The internal combustion engine as set forth in claim 64 wherein said second carrier bearing further includes a generally planar, horizontally disposed upper bearing face and lower bearing face.

66. The internal combustion engine as set forth in claim 65 wherein said internal housing further includes a second internal housing bearing in sliding engagement with said second carrier bearing.

67. The internal combustion engine as set forth in claim 63 wherein said internal housing further includes a fuel injection means disposed on said cylinder sleeve valve.

68. The internal combustion engine as set forth in claim 67 wherein said fuel injection means is centrally disposed on said cylinder sleeve valve so as to enable the injection of fuel into a combustion chamber defined between the first combustion surface and the second combustion surface interior of the cylinder sleeve valve.

69. The internal combustion engine as set forth in claim 68 wherein said engine further includes a sleeve oscillating means for rotationally oscillating said cylinder sleeve valve.

70. The internal combustion engine as set forth in claim 69 wherein said sleeve oscillating means further includes a rack gear affixed to said external housing.

71. The internal combustion engine as set forth in claim 70 wherein said rack gear further includes gear teeth extending inwardly toward the internal housing.

72. The internal combustion engine as set forth in claim 70 wherein said sleeve oscillating means further includes a gear sector affixed to said cylinder sleeve valve.

73. The internal combustion engine as set forth in claim 72 wherein said gear sector further includes gear teeth extending toward said external housing and engaging the gear teeth of said rack gear.

74. The internal combustion engine as set forth in claim 69 wherein said sleeve oscillating means further includes a first boss affixed to the external housing.

75. The internal combustion engine as set forth in claim 74 wherein said sleeve oscillating means further includes a second boss affixed to the cylinder sleeve valve.

76. The internal combustion engine as set forth in claim 75 wherein said sleeve oscillating means further includes a sleeve link extending between the first boss and the second boss.

77. The internal combustion engine as set forth in claim 76 wherein said sleeve oscillating means further includes a first link pin pivotally securing the sleeve link to the first boss.

78. The internal combustion engine as set forth in claim 77 wherein said sleeve oscillating means further includes a second link pin pivotally securing the sleeve link to the second boss.

79. The internal combustion engine as set forth in claim 78 wherein said second boss is affixed to said fuel injection means.

80. The internal combustion engine as set forth in claim 79 wherein said sleeve link further defines an interior void extending between the first boss and the second boss through which fluid may be supplied.

81. The internal combustion engine as set forth in claim 80 wherein the fluid supplied through said sleeve link is fuel.

82. The internal combustion engine as set forth in claim 81 wherein the fluid supplied through said sleeve link is coolant.

83. An internal combustion engine comprised of:

an external housing having a cylindrical, upwardly disposed first piston sleeve and a cylindrical, downwardly disposed second piston sleeve;

an internal housing disposed in said external housing, said internal housing defining an operating chamber and further including a cylindrical center section with an upper exterior surface upon which is disposed an upwardly directed first piston member in reciprocating engagement with said first piston sleeve, and a lower exterior surface upon which is disposed a downwardly directed second piston member in reciprocating engagement with said second piston sleeve;

a cylinder sleeve valve disposed in the operating chamber of said internal housing, said cylinder sleeve valve further defining at least one sleeve intake window and at least one sleeve exhaust window;

a sleeve oscillating means for rotationally oscillating said cylinder sleeve valve;

a third piston member is disposed for reciprocating operation in the operating chamber of the internal housing; and a fourth piston member is disposed for reciprocating operation in the operating chamber of the internal housing, so as to define between said third piston member and said fourth piston member a combustion chamber in the operating chamber of said internal housing.

84. The internal combustion engine as set forth in claim 83 wherein said sleeve oscillating means further includes a rack gear affixed to said external housing.

85. The internal combustion engine as set forth in claim 84 wherein said rack gear further includes gear teeth extending inwardly toward the internal housing.

86. The internal combustion engine as set forth in claim 85 wherein said sleeve oscillating means further includes a gear sector affixed to said cylinder sleeve valve.

87. The internal combustion engine as set forth in claim 86 wherein said gear sector further includes gear teeth extending toward said external housing and engaging the gear teeth of said rack gear.

88. The internal combustion engine as set forth in claim 87 wherein said sleeve oscillating means further includes a first boss affixed to the external housing.

89. The internal combustion engine as set forth in claim 83 wherein said sleeve oscillating means further includes a second boss affixed to the cylinder sleeve valve.

90. The internal combustion engine as set forth in claim 89 wherein said sleeve oscillating means further includes a sleeve link extending between the first boss and the second boss.

91. The internal combustion engine as set forth in claim 90 wherein said sleeve oscillating means further includes a first link pin pivotally securing the sleeve link to the first boss.

92. The internal combustion engine as set forth in claim 91 wherein said sleeve oscillating means further includes a second link pin pivotally securing the sleeve link to the second boss.

93. The internal combustion engine as set forth in claim 92 wherein said second boss is affixed to said fuel injection means.

94. The internal combustion engine as set forth in claim 93 wherein said sleeve link further defines an interior void extending between the first boss and the second boss through which fluid may be supplied.

95. The internal combustion engine as set forth in claim 94 wherein the fluid supplied through said sleeve link is fuel.

96. The internal combustion engine as set forth in claim 95 wherein the fluid supplied through said sleeve link is coolant.

97. The internal combustion engine as set forth in claim 83 wherein said cylinder sleeve valve is selectively timed to rotationally align the sleeve exhaust window to permit a flow of combustion gases from the combustion chamber.

98. The internal combustion engine as set forth in claim 97 wherein said cylinder sleeve valve is selectively timed to rotationally align the sleeve intake window to permit a flow of intake air into the combustion chamber.

99. An internal combustion engine comprised of:

an external housing having a cylindrical, upwardly disposed first piston sleeve with a first piston cylinder head, and a cylindrical, downwardly disposed second piston sleeve with a second piston cylinder head;

an intake valve means disposed on said first piston cylinder head to selectively permit an induction of intake air into the external housing;

an exhaust valve means disposed on said second cylinder head for selectively permitting an exhaust of combustion gases from said external housing;

an internal housing disposed in said external housing, said internal housing defining an operating chamber and further including a cylindrical center section having an internal diameter L, said center section further having an upper exterior surface upon which is disposed an upwardly directed first piston member in reciprocating engagement with said first piston sleeve and a lower exterior surface upon which is disposed a downwardly directed second piston member in reciprocating engagement with said second piston sleeve;

a cylinder sleeve valve disposed in the operating chamber of said internal housing, said cylinder sleeve valve further defining at least one sleeve intake window and at least one sleeve exhaust window;

a sleeve oscillating means for rotationally oscillating said cylinder sleeve valve to cause timed, selected rotational positioning of the cylinder sleeve valve in response to changes in position of the internal housing within the external housing;

a third piston member is disposed for reciprocating operation in the operating chamber of the internal housing, said third piston member further including a third piston head disposed in said cylinder sleeve valve; and a fourth piston member is disposed for reciprocating operation in the operating chamber of the internal housing, so as to define between said third piston member and said fourth piston member a combustion chamber in the operating chamber of said internal housing, said fourth piston member further including a fourth piston head disposed in said cylinder sleeve valve.

100. The internal combustion engine as set forth in claim 99 wherein said first piston member further includes a first piston base portion.

101. The internal combustion engine as set forth in claim 100 wherein said first piston base portion further includes a first piston valve window, and further wherein said sleeve intake window is selectively rotationally aligned with said first piston valve window to permit a flow of intake air into the combustion chamber.

102. The internal combustion engine as set forth in claim 101 wherein said second piston member further includes a second piston base portion.

103. The internal combustion engine as set forth in claim 102 wherein said second piston base portion further includes a second piston valve window, and further wherein said sleeve exhaust window is selectively rotationally aligned with said second piston valve window to permit a flow of combustion gases from the combustion chamber.

104. The internal combustion engine as set forth in claim 103 wherein said internal combustion engine further includes a horizontally disposed first crankshaft and parallel, horizontally disposed second crankshaft spaced apart from said first crankshaft.

105. The internal combustion engine as set forth in claim 104 wherein said first crankshaft further includes a first offset crankshaft portion and said second crankshaft further includes a second offset crankshaft portion.

106. The internal combustion engine as set forth in claim 105 wherein said first offset crankshaft portion is offset by a distance A from the axis of the first crankshaft and said second offset crankshaft portion is offset by a distance A from the axis of the second crankshaft.

107. The internal combustion engine as set forth in claim 106 wherein said internal housing further includes internal housing sidewalls at distal ends of the internal housing.

108. The internal combustion engine as set forth in claim 107 wherein said internal housing sidewalls further define a first ovoidal slot through which the first offset crank portion passes freely.

109. The internal combustion engine as set forth in claim 108 wherein said internal housing sidewalls further define a second ovoidal slot through which the second offset crank portion passes freely.

110. The internal combustion engine as set forth in claim 109 wherein said engine further includes a crankshaft phasing means.

111. The internal combustion engine as set forth in claim 110 wherein said crankshaft phasing means further includes a first phase gear secured to the first crankshaft and a second phase gear secured to the second crankshaft.

112. An internal combustion engine comprised of:

an external housing having a cylindrical, upwardly disposed first piston sleeve with a first piston cylinder head, and a cylindrical, downwardly disposed second piston sleeve with a second piston cylinder head;

an intake valve means disposed on said first piston cylinder head to selectively permit an induction of intake air into the external housing;

an exhaust valve means disposed on said second cylinder head for selectively permitting an exhaust of combustion gases from said external housing;

an internal housing disposed in said external housing, said internal housing defining an operating chamber and further including a cylindrical center section having an internal diameter L, said center section further having an upper exterior surface upon which is disposed an upwardly directed first piston member in reciprocating engagement with said first piston sleeve, said first piston member further including a frusto-conical first piston wall having a coni-form of angle α, and a first piston base portion through which a first piston valve window is defined; said center section further including a lower exterior surface upon which is disposed a downwardly directed second piston member in reciprocating engagement with said second piston sleeve, said second piston member further including a frusto-conical second piston wall having a coni-form of angle β, and a second piston base portion through which a second piston valve window is defined;

internal housing sidewalls at distal ends of the internal housing, said internal housing sidewalls defining a first ovoidal slot through which the first offset crank portion passes, and said internal housing sidewalls further defining a second ovoidal slot through which the second offset crank portion passes;

a first internal housing bearing adjacent said first ovoidal slot, said first internal housing bearing having a generally planar, horizontally disposed upper bearing face and lower bearing face;

a second internal housing bearing adjacent said second ovoidal slot, said second internal housing bearing having a generally planar, horizontally disposed upper bearing face and lower bearing face;

a horizontally disposed first crankshaft, said first crankshaft including a first offset crankshaft portion offset by a distance A from the axis of the first crankshaft;

a horizontally disposed second crankshaft parallel to and spaced apart from said first crankshaft, said second crankshaft including a second offset crankshaft portion offset by a distance A from the axis of the second crankshaft;

a crankshaft phasing means including a first phase gear secured to the first crankshaft and a second phase gear secured to the second crankshaft;

a cylinder sleeve valve disposed in the operating chamber of said internal housing, said cylinder sleeve valve further defining at least one sleeve intake window and at least one sleeve exhaust window;

a sleeve oscillating means for rotationally oscillating said cylinder sleeve valve to cause timed, selected rotational positioning of the cylinder sleeve valve in response to changes in position of the internal housing within the external housing;

a third piston member is disposed for reciprocating operation in the operating chamber of the internal housing, said third piston member including a third piston head disposed in said cylinder sleeve valve, said third piston member further including a third piston crank bearing assembly, said third piston crank bearing assembly having a third piston bearing for rotationally engaging the first offset crank portion, and a first carrier bearing for engaging the first internal housing bearing; and a fourth piston member is disposed for reciprocating operation in the operating chamber of the internal housing, so as to define between said third piston member and said fourth piston member a combustion chamber in the operating chamber of said internal housing, said fourth piston member including a fourth piston head disposed in said cylinder sleeve valve, said fourth piston member further including a fourth piston crank bearing assembly, said fourth piston crank bearing assembly having a fourth piston bearing for rotationally engaging the second offset crank portion, and a second carrier bearing for engaging the second internal housing bearing.

* * * * *